US009661414B2

(12) United States Patent
Le Roux et al.

(10) Patent No.: US 9,661,414 B2
(45) Date of Patent: May 23, 2017

(54) FLAT-PANEL ACOUSTIC APPARATUS

(71) Applicant: Mitsubishi Electric Research Laboratories, Inc., Cambridge, MA (US)

(72) Inventors: Jonathan Le Roux, Arlington, MA (US); John R Hershey, Winchester, MA (US); William S. Yerazunis, Acton, MA (US); Petros T Boufounos, Arlington, MA (US); Laurent Daudet, Paris (FR)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 0 days.

(21) Appl. No.: 14/735,403

(22) Filed: Jun. 10, 2015

(65) Prior Publication Data

US 2016/0366511 A1 Dec. 15, 2016

(51) Int. Cl.

| | |
|---|---|
| ***H04R 25/00*** | (2006.01) |
| ***H04R 1/34*** | (2006.01) |
| ***H04R 1/28*** | (2006.01) |
| *H04R 17/02* | (2006.01) |
| *H04R 19/04* | (2006.01) |
| *H04R 11/04* | (2006.01) |

(52) U.S. Cl.

CPC ..... *H04R 1/345* (2013.01); *H04R 1/28* (2013.01); *H04R 11/04* (2013.01); *H04R 17/02* (2013.01); *H04R 19/04* (2013.01)

(58) Field of Classification Search

CPC ..... H04R 1/345; H04R 1/28; H04R 11/04; H04R 19/04; H04R 17/02

USPC ..... 381/160

See application file for complete search history.

(56) References Cited

U.S. PATENT DOCUMENTS

| | | | | |
|---|---|---|---|---|
| 6,148,089 | A | 11/2000 | Akino | |
| 2002/0110256 | A1 * | 8/2002 | Watson | B60R 1/12 381/389 |
| 2004/0184632 | A1 * | 9/2004 | Minervini | H04R 1/028 381/355 |
| 2006/0109996 | A1 * | 5/2006 | Larson | H04N 7/18 381/365 |
| 2006/0116180 | A1 * | 6/2006 | Minervini | H04R 1/028 455/575.1 |
| 2006/0153390 | A1 * | 7/2006 | Iwaki | G01C 21/3629 381/13 |
| 2014/0262600 | A1 * | 9/2014 | Hughes, II | H04R 1/30 181/184 |

* cited by examiner

*Primary Examiner* — Duc Nguyen
*Assistant Examiner* — Sean H Nguyen
(74) *Attorney, Agent, or Firm* — Gene Vinokur; James McAleenan; Hironori Tsukamoto

(57) ABSTRACT

In an acoustic apparatus, an acoustic transducer is arranged in a substrate. Multiple acoustic pathways in the substrate have predetermined lengths, wherein a proximal end of each pathway forms an opening in a front surface of the substrate, and a distal end terminates at the acoustic transducer. The predetermined lengths of the acoustic pathways are designed to form an acoustic spatial filter that selectively passes acoustic signals from or to different locations. The transducer can convert electric energy to acoustic energy when the apparatus operates as a speaker, or the the transducer can convert acoustic energy to electric energy and operate as a microphone.

19 Claims, 22 Drawing Sheets

FLAT-PANEL ACOUSTIC APPARATUS

FIELD OF THE INVENTION

This invention generally relates to the field of directional acoustic transducers, and in particular, phased-array acoustic transducers.

BACKGROUND OF THE INVENTION

Directional acoustic phased arrays can be used in applications, such as aircraft location apparatus that operated as a four-point phased array. Although acoustic detection systems for aircraft are inferior to radar-based detection systems, the principles of acoustic signal focusing and acoustic phased arrays can be applied successfully in other applications.

For example, consider a parabolic microphone where the transducer faces the surface of a parabolic reflector. The shape of a parabola is such that there is a constant time of flight for acoustic signals emitted by a distant source to the surface of the parabolic reflector and then to the transducer.

Given constant time of flight, the different wave pathways have constructive interference and provide a strong signal along an axis of the reflector. Other directions have varying times of flight so the acoustic waves have destructive interference.

The parabola is not the only possible shape for a directional acoustic system. The "shotgun microphone" includes a long tube, often up to a meter long, with holes or slots arranged along its length. The acoustic transducer is mounted at distal end of the tube with respect to the signal source. Acoustic energy approaching the tube enters the slots or the holes and propagates down the tube to the acoustic transducer.

Just as in the case of the parabolic microphone, acoustic energy approaching along the axis of the tube experiences constant and equal time delays no matter through which slot or hole the energy enters, and so experiences constructive interference. Acoustic energy approaching from other directions propagates to the transducer with unequal time delays and experiences destructive interference, and little if any signal is produced by the transducer.

Unfortunately, both the shotgun microphone and the parabolic microphone have a serious shortcoming—physical size. A parabolic microphone is typically a deep dish 40 cm to 1 m in diameter and half that in depth. A shotgun microphone is a long rod, about 3 cm in diameter and a meter or more long. These shapes are difficult to integrate into an office, retail, home, or automotive environment.

It is an object of the current to produce a directional acoustic transducer with a more useful form factor than the parabolic or shotgun microphones, yet with similar or better directionality.

Noise-cancelling microphones typically use two ports through which the acoustic signal enters, one in the front of the sensor, and one in the back, with the microphone's sensor arranged between the ports. These types of microphones are only appropriate when the source is close to the microphone.

U.S. Pat. No. 6,148,089 describes a unidirectional microphone including a microphone unit having a front acoustic terminal, and a rear acoustic terminal, which is provided in a flat-faced surface such as an outer frame of a display panel for computer, includes a unit fitting portion provided on the flat-faced surface for fitting said microphone unit, the top surface of the plane being flat with respect to the top surface of the front acoustic terminal of the microphone unit, a baffle substrate mounted on the side of the front acoustic terminal of the microphone unit to be disposed in the opening surface of the unit fitting portion, and a side acoustic terminal provided about the baffle substrate in communication with the rear acoustic terminal.

SUMMARY OF THE INVENTION

The embodiments of the invention prove a directional phased-array acoustic apparatus that has a substantially thin planar configuration. This allows the apparatus to be conveniently embedded, for example into the ceiling or wall of a room, or in an overhead ceiling as in a vehicle.

The main feature of this apparatus is to embed pathways within a substrate of the apparatus such that there are multiple pathways of similar length from a source at a particular direction or location of an acoustic signal to one or more acoustic transducers, while the pathways from other directions/locations to the transducers can be of different lengths.

DETAILED DESCRIPTION OF THE PREFERRED EMBODIMENTS

The embodiments of our invention provide an acoustic apparatus that can produce a directive acoustic device for accommodating an acoustic signal for a selected target location, by varying lengths of acoustic pathways, so that the acoustic pathways from the acoustic transducer to the opening of the pathway at the surface of the device and then to the desired external acoustic target location is a constant, i.e., acoustic energy passing between the desired external target (acoustic source if acting as a microphone, or a listener if acting as a speaker, follows the same total distance and therefore takes the same amount of time.

This can be understood by realizing that constant distance, not necessarily along a straight pathway, yields a situation where the desired acoustic energy is in phase and accumulates, rather than being out of phase and cancelling. Thus, a combination of straight and curved pathways may be used to produce the proper phase relationship for any desired target direction or target location.

As a consequence of this curved pathway equivalence, multiple openings can be placed freely on the front surface of the apparatus. This increases the total energy-collecting area of the apparatus, improving sensitivity. The openings can be arranged, e.g., in a circular pattern, in a regular grid, or in an aesthetically pleasing pattern or otherwise desirable pattern, such as a manufacturer's logo.

Figure 1:
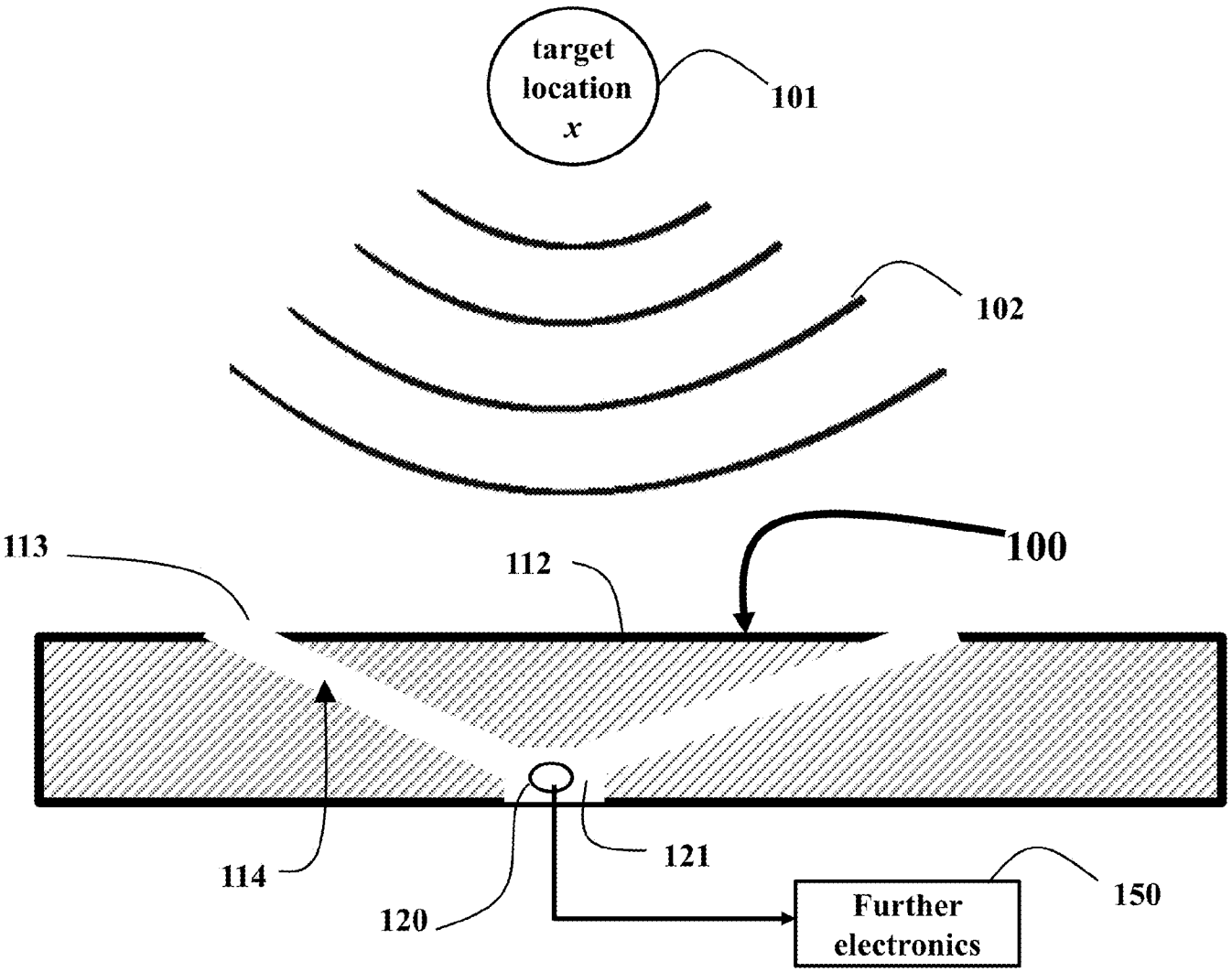
FIG. 1 is a cross-sectional view of an acoustic apparatus, and a schematic of an acoustic environment in which the acoustic apparatus operates according to one embodiment of the invention.

FIG. 1 shows a cross sectional view of the apparatus 100 according to one embodiment of the invention. A target location 101 can emit (as shown) acoustic energy 102 or receive acoustic energy, depending on whether the apparatus is operating as a microphone or speaker. The acoustic energy can propagate to or from a transducer 120 arranged in an acoustic cavity 121 formed in a relatively thin substrate 112. That is, the transducer is internal to the substrate. For example, a width and a length of the substrate are about two orders of magnitude larger than a thickness.

Figure 3:
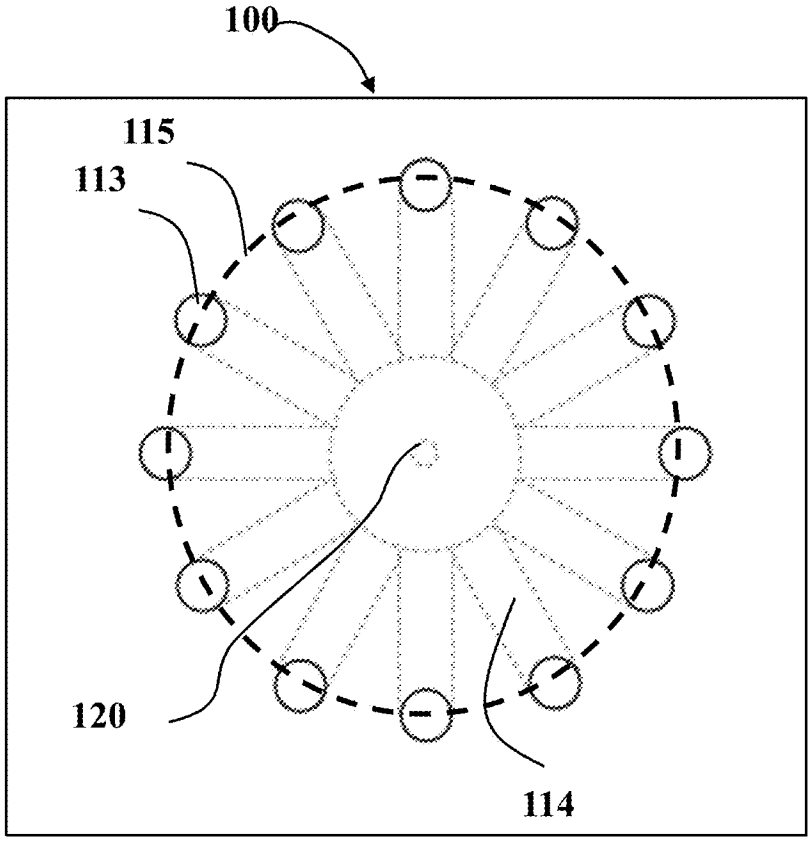
FIG. 3 is a top view of a front surface of the acoustic apparatus according to one embodiment of the invention.
Figure 2:
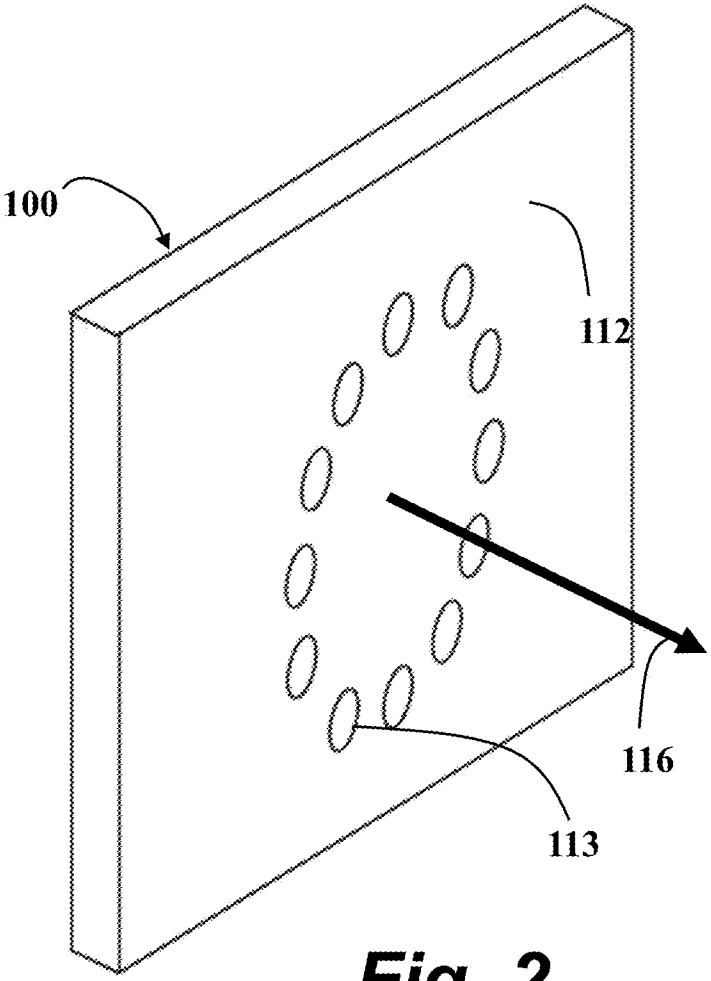
FIG. 2 is an isometric view of a front of the acoustic apparatus of FIG. 1 according to one embodiment of the invention.

The front side of the substrate 112, see also FIGS. 2 and 3, facing the source is perforated by a number of openings 113 with pathways 114 having predetermined lengths. The predetermined lengths of the acoustic pathways are designed to form a spatial filter that selectively passes acoustic signals between different locations and an acoustic cavity 121 in the substrate 112. The cavity houses the acoustic transducer, which can be a microphone or a speaker 120 depending on a desired operating mode. The electrical signals from or to the transducer 120 are supplied to or by electronics 150, such as a processor, a cellphone, or a voice recognition system.

Referring now to FIGS. 2 and 3, showing the same implementation in isometric and front view, we can see that the openings 113 are arranged, e.g., in a circle, and each opening 113 leads to one of the pathway 114, and the pathways lead to the acoustic cavity 121 and transducer 120. In this implementation, the lengths of the pathways from the openings 113 to the transducer 120 are all arranged on radii of a circle 115, and hence the pathways have equal lengths. The cavity can include multiple transducers.

Any acoustic energy source, such as a person speaking, generates an in-phase, constructive interference at the transducer 120, if and only if that person is located along the axis 116 of symmetry of the circle 115 of openings 113.

Figure 4:
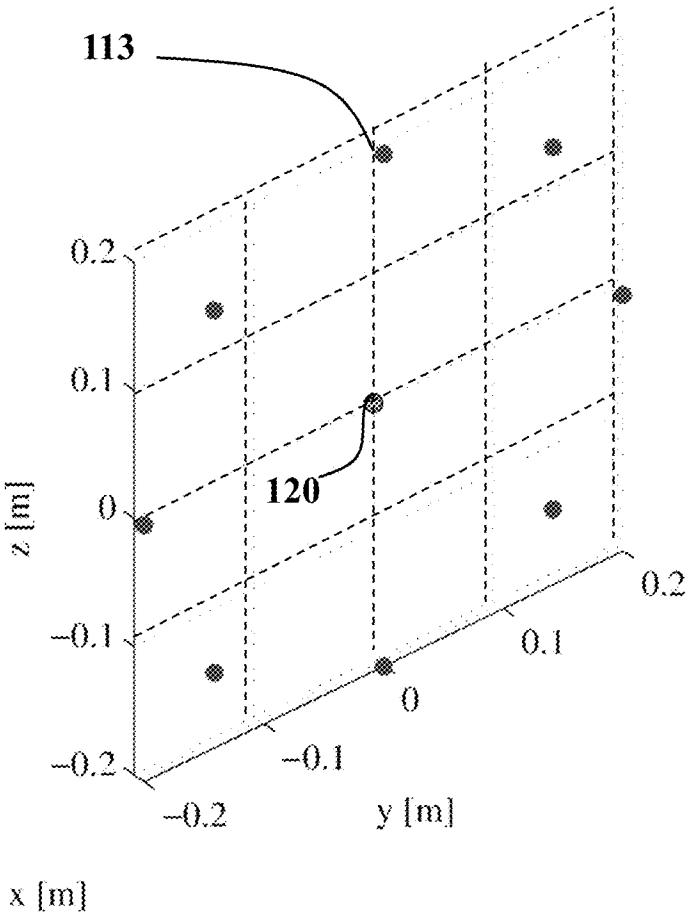
FIGS. 4, 6, and 8 are schematic of various configurations of openings in the front surface of the acoustic apparatus according to embodiments of the invention.
Figure 5:
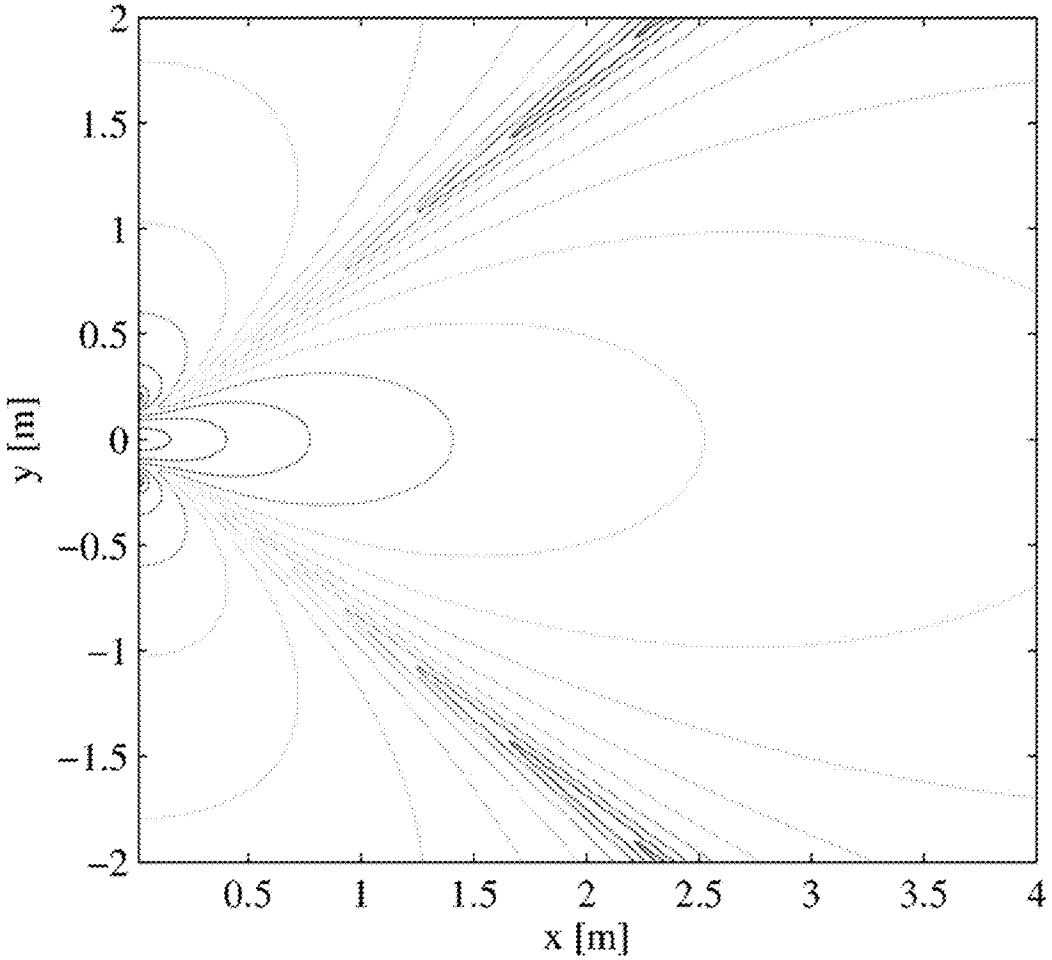
FIGS. 5, 7, and 9 are corresponding energy attenuation patterns for the configurations shown in FIGS. 4, 6 and 8.
Figure 6:
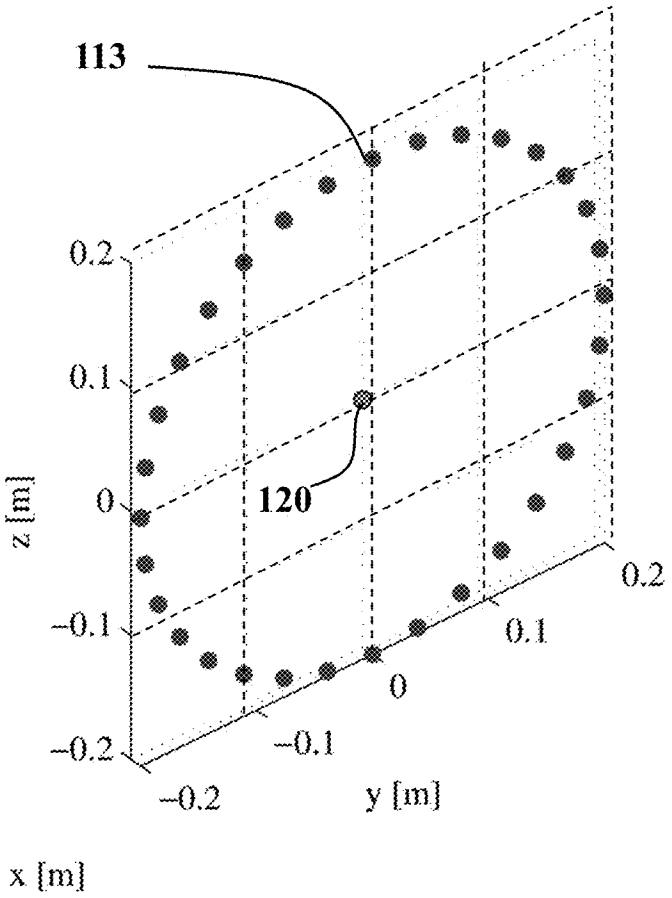

Referring now to FIGS. 4 and 6, these embodiments have 8 and 32 openings 113 respectively, all disposed in a circular ring in the YZ plane around the transducer 120. The sensitivity pattern in the perpendicular XY plane for this system as simulated is shown in FIGS. 5 and 7, respectively.

Figure 7:
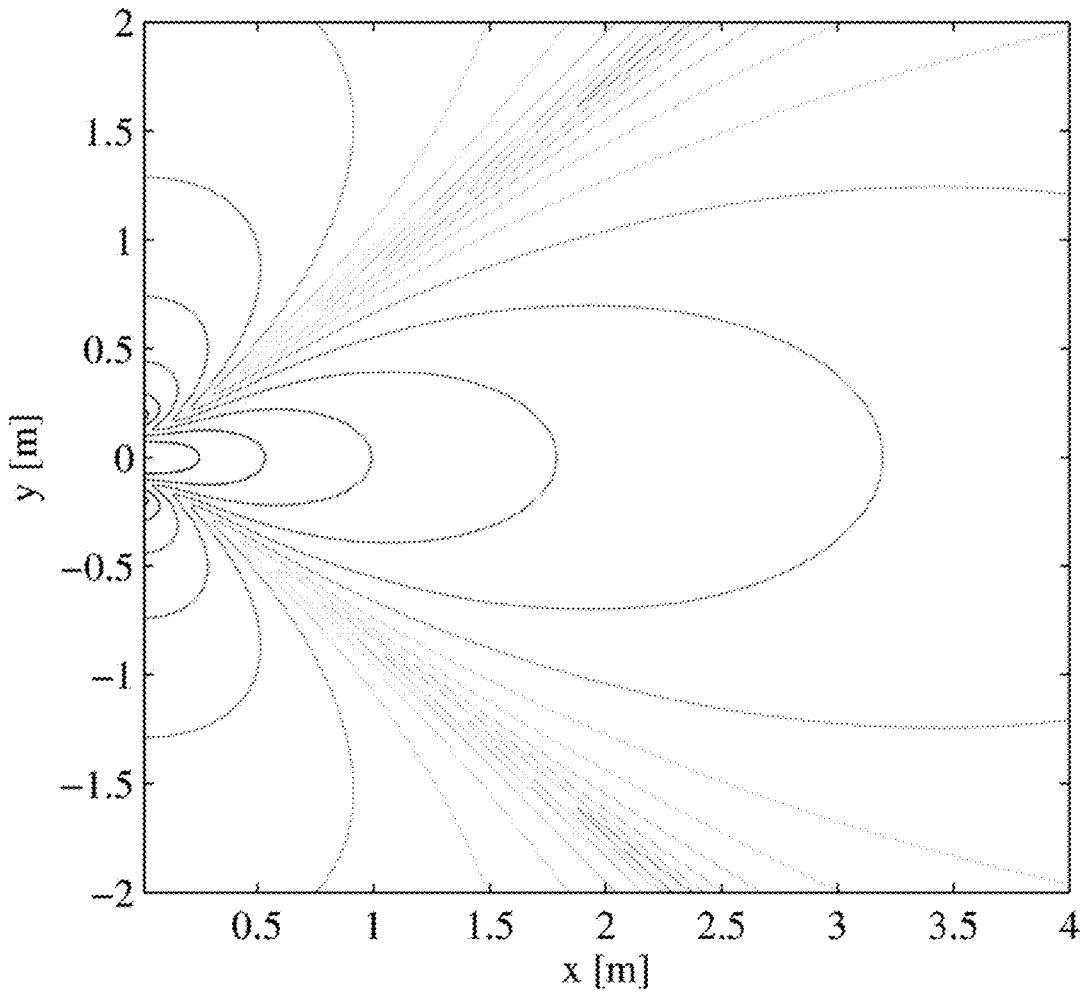

As can be seen from FIGS. 5 and 7, the acoustic sensitivity of the apparatus has a much-desired single-directional aspect so that the apparatus is much more sensitive to acoustic signals originating from a source perpendicular 116 to the plane of the openings 113 than from acoustic signals originating off-axis.

Figure 8:
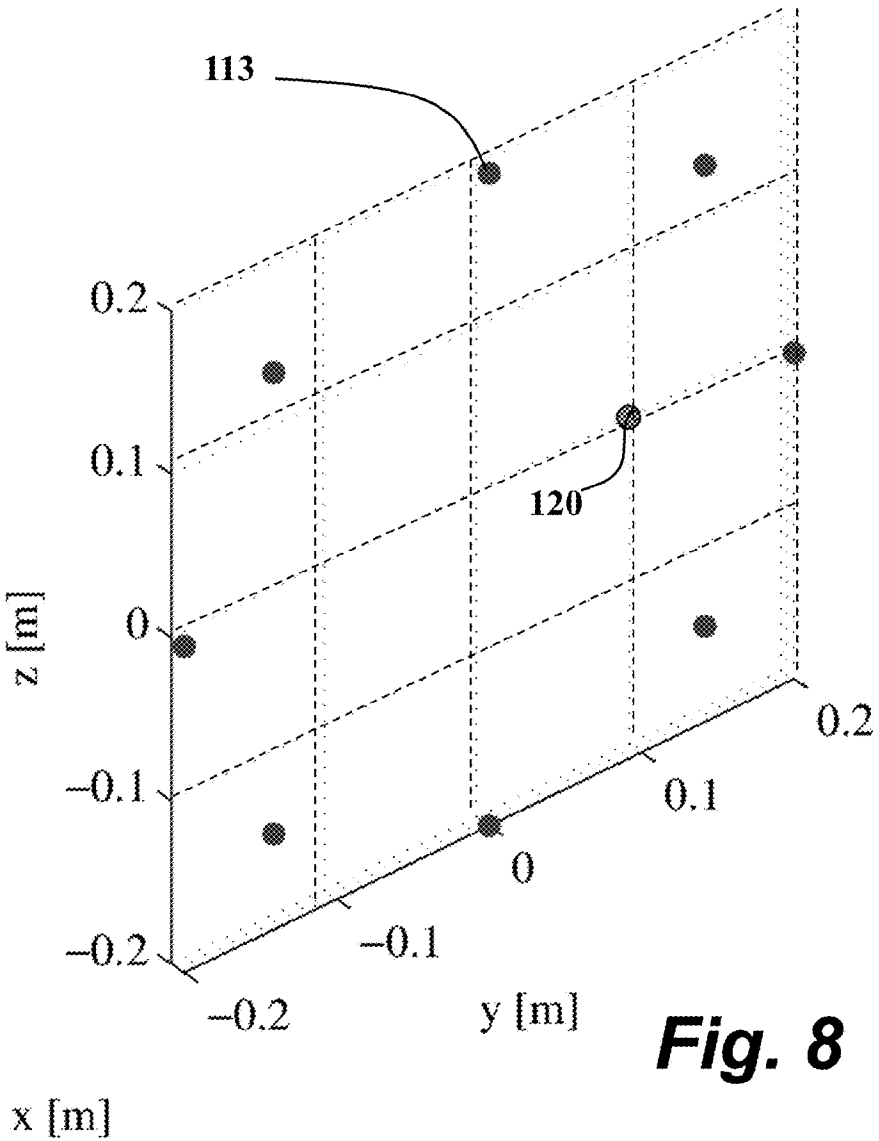

In FIG. 8, we show another embodiment. Unlike a shotgun or parabolic microphone, the planar opening array can produce a detection pattern that is skewed off-axis. Again, eight openings 113 are disposed in a circular ring in the YZ plane, but the transducer 120 is moved to halfway between the center and the edge of the ring of openings 113.

Figure 9:
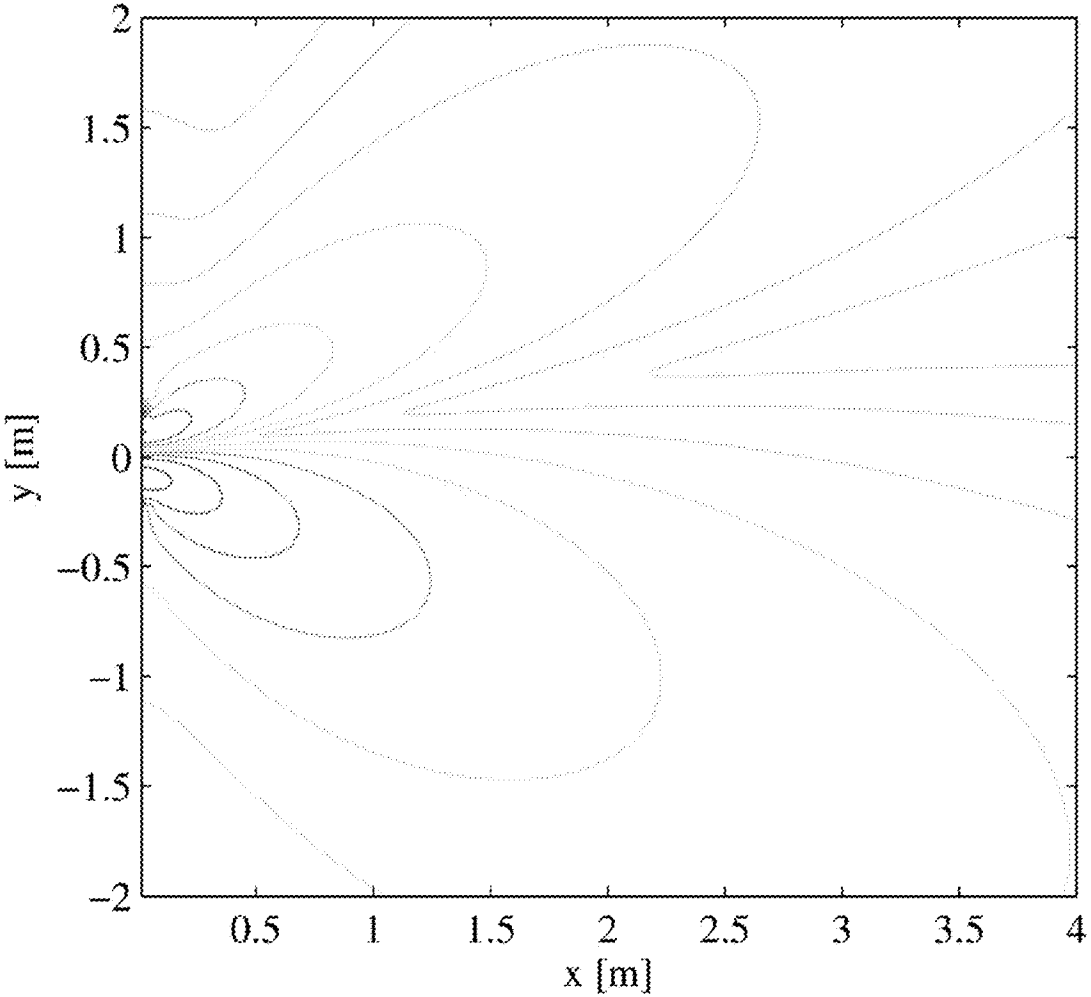

FIG. 9 shows the result with a skewing of the zones of higher and lower sensitivities in the XY plane.

Figure 10:
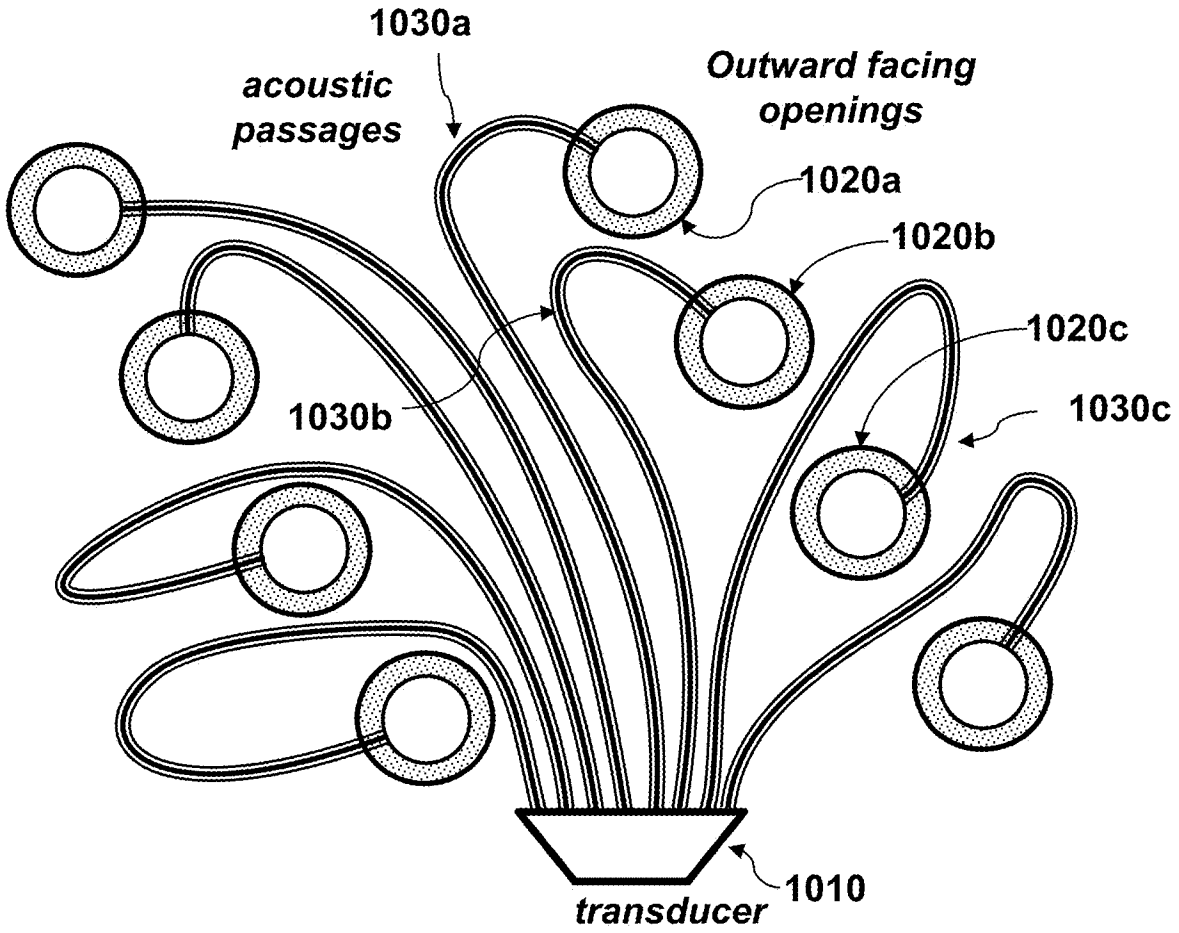
FIG. 10 is a schematic of a decorative pattern of openings according to one embodiment of the invention.

FIG. 10 shows an embodiment with a non-circular, non-rectangular array of openings, in this case, two rows of diagonal openings, which may be considered as an arbitrary, but perhaps, decorative, arrangement, sufficient for description of non-circular arrays of openings.

Acoustic energy from the source area enters the substrate through openings 1020*a*, 1020*b*, 1020*c*, etc. (only the first three of eight labeled for clarity), and proceeds through the acoustic pathways 1030*a*, 1030*b*, 1030*c* etc. (again, only the first three of eight labeled for clarity).

This embodiment produces a perpendicularly directive acoustic apparatus, all of the acoustic pathways 1030*a*, 1030*b*, 1030*c* etc. being carefully designed to be of equal length, so all of the acoustic energy from each opening 1020*a*, 1020*b*, 1020*c* etc., arrives at transducer 1010 with the same time delay, and hence the same phase. Therefore, the acoustic energy at the transducer is combined with positive reinforcement, producing a strongly directed response, and in this case of equal acoustic pathway time delay, the strong direction of the response is in the direction perpendicular 116 to the plane of arrangement, in this case out of the plane of FIG. 10.

Figure 11:
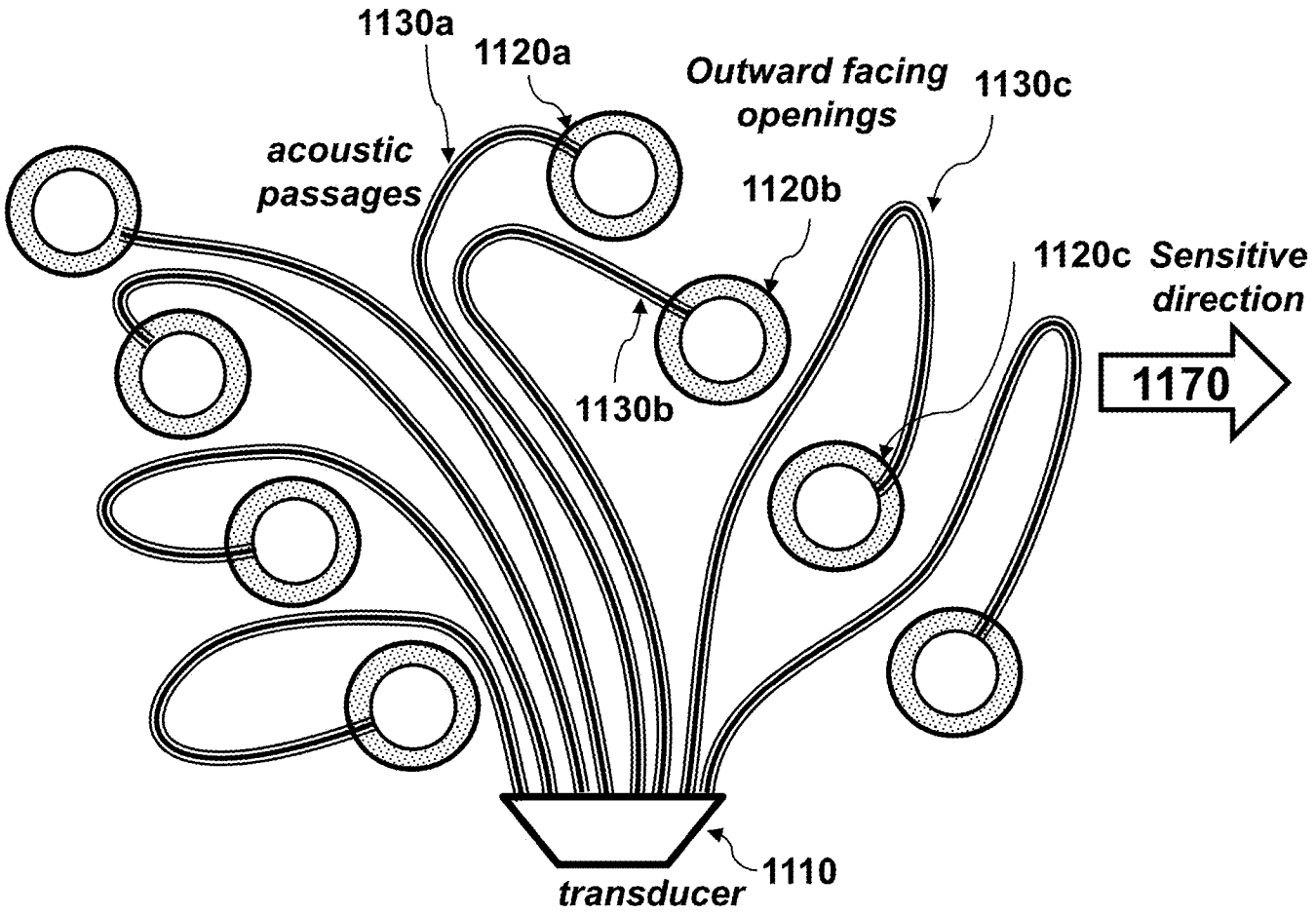
FIG. 11 is a schematic of a decorative pattern of openings with a preferred sensitivity direction.

Referring now to FIG. 11, we see the same positions of transducer 1110 and openings 1120*a*, 1120*b*, 1120*c*, etc., in the same decorative double-diagonal arrangement. However, the acoustic pathways 1130*a*, 1130*b*, 1130*c*, etc., are designed so that they form a constant time delay for acoustic signals emanating from the right direction 1170. Acoustic energy originating from the right side of the array enters the openings 1120*a*, 1120*b*, 1120*c*, etc., and because of the combination of time difference of arrival to each opening and different acoustic pathway lengths, arrive at transducer 1110 with the same time delay, and hence the same phase, and combine with positive reinforcement giving a strong response by transducer 1110. Acoustic energy entering the openings perpendicularly, or in other directions than from the right of the figure have different time delays and arrive at transducer 1110 out of phase, causing destructive interference, and little or no response from the transducer 1110.

In the configurations showed in FIGS. 14-19, as described in greater detail below, the acoustic pathways can form a branched tree, where a single pathway can split into several pathways, either dividing or combining acoustic energy according to a desired direction of operation.

Figure 16:
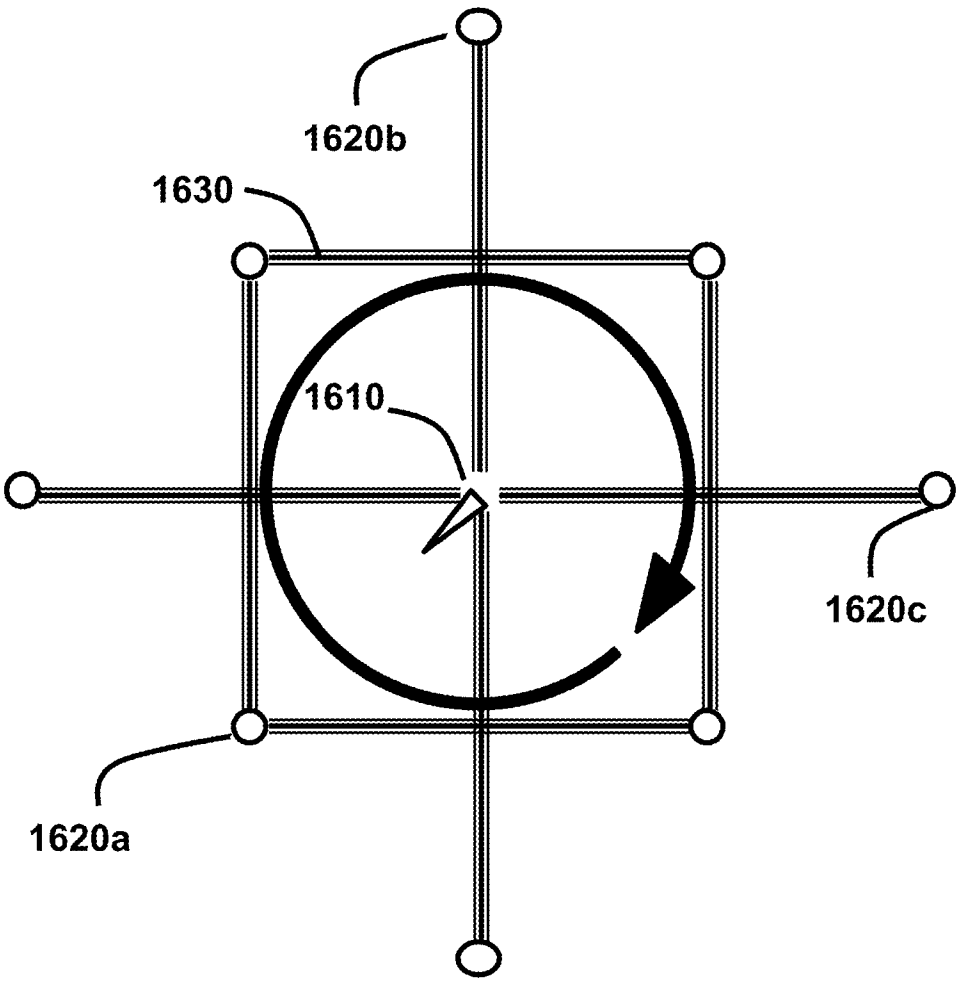
Figure 17:
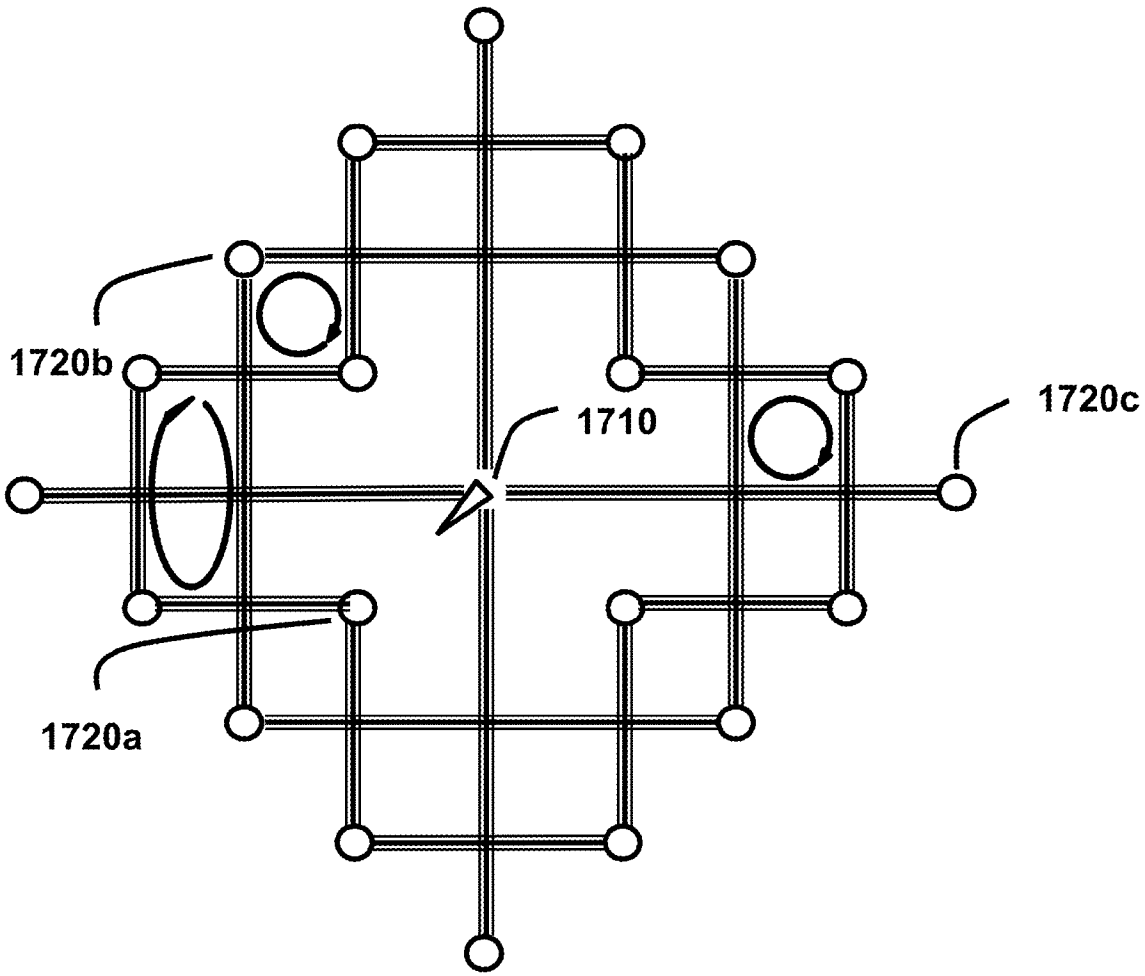
Figure 18:
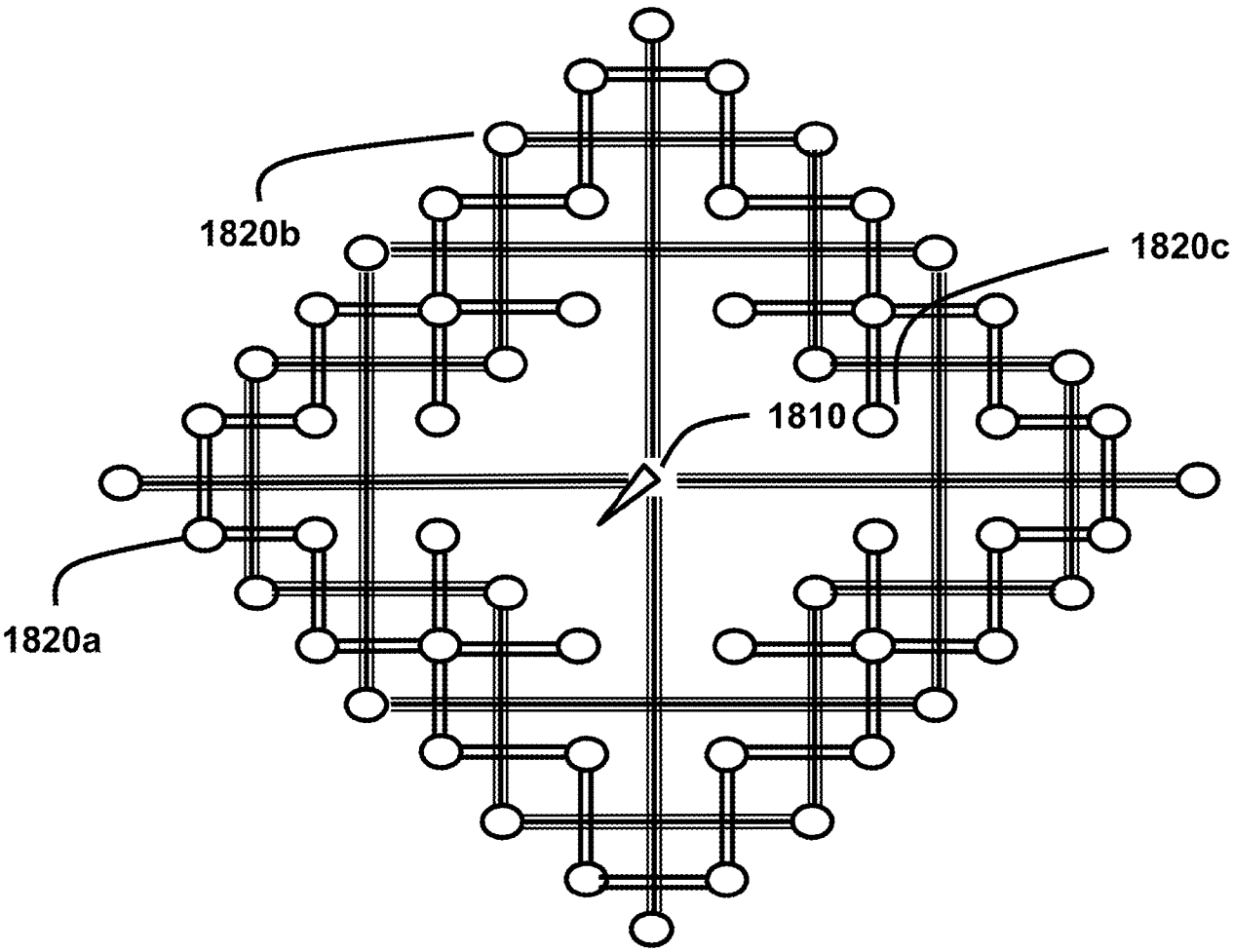
Figure 19:
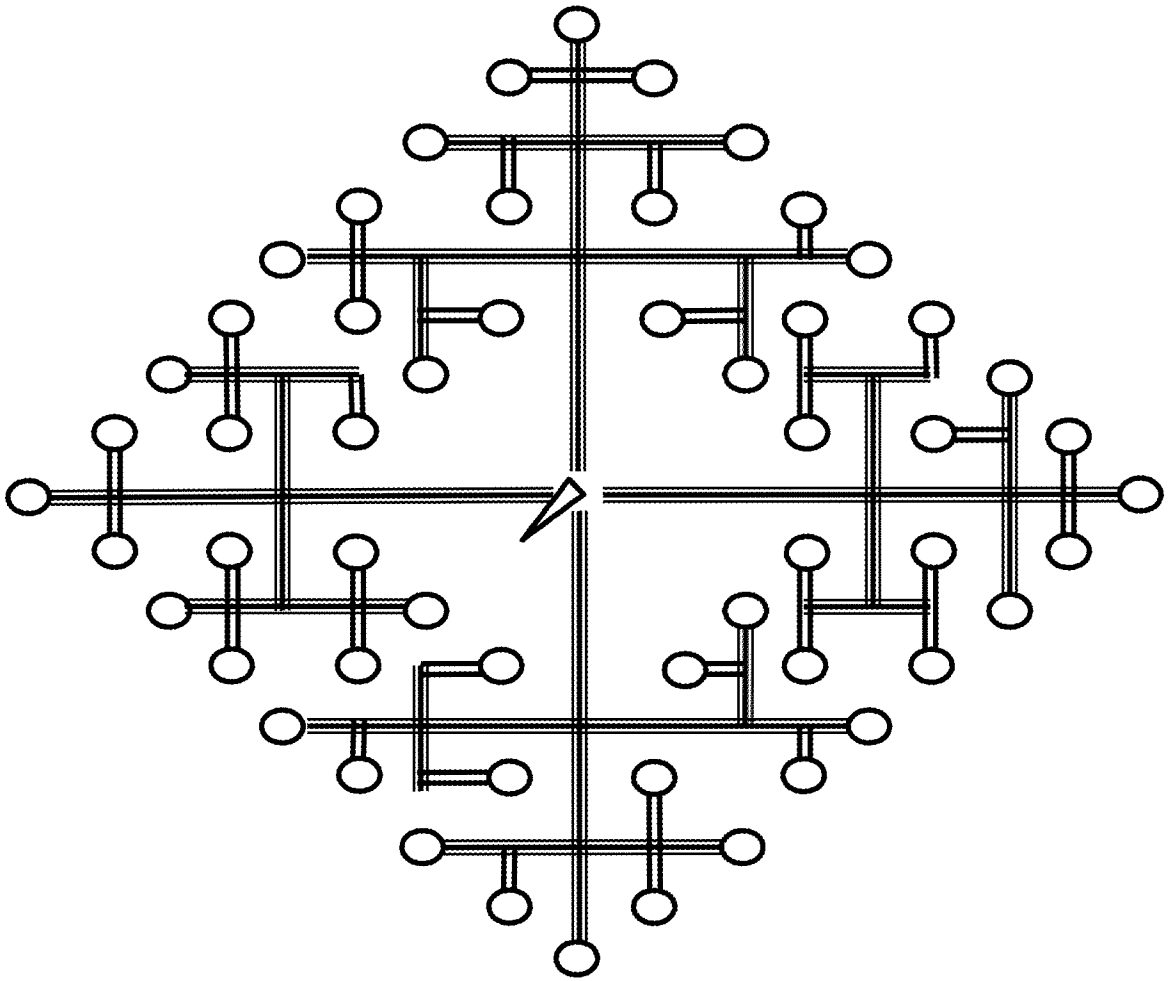

In FIGS. 16-18 there are cyclic pathways, for example as indicated by directed arrows, which can reduce the effectiveness, because there are pathways of different lengths. FIG. 19 is different from FIGS. 16-18 because it is an arbitrary tree without cycles.

Figure 14:
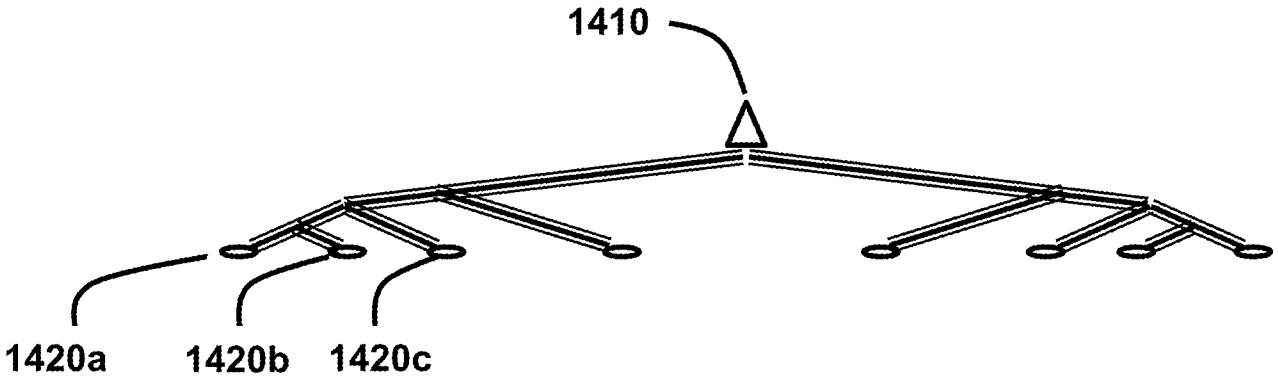
FIGS. 14, 15, 16, 17, 18, and 19 show alternative arrangements of openings and pathways according to embodiments of the invention.

FIG. 14 shows an embodiment with multiple branches in cross-section. The lengths of each pathway from the openings 1420*a*, 1420*b*, 1420*c*, etc., to the transducer 1410 are designed to be equal. This embodiment thus favors directions in the plane that passes through the transducer 1410 and is normal to the line that goes through the openings 1420*a*, 1420*b*, 1420*c*, etc.

Figure 15:
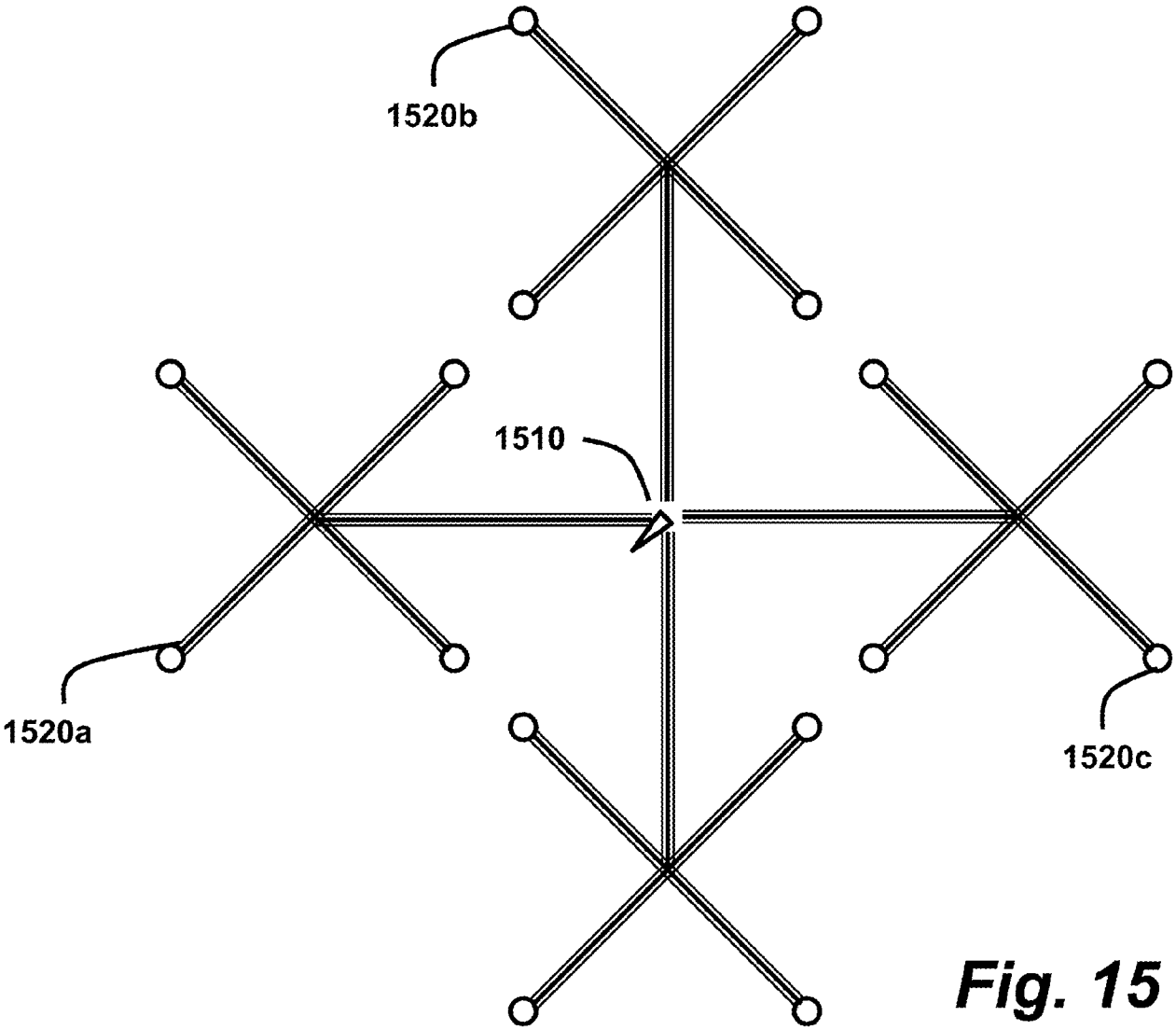

FIG. 15 shows another embodiment wherein the pathways have multiple branches, in front view. Again, the lengths of each pathway from the openings 1520*a*, 1520*b*, 1520*c*, etc., to the transducer 1510 are designed to be equal. This embodiment thus favors the direction perpendicular to the plane of arrangement.

FIGS. 16 and 17 show front views of two other embodiments with multiple branches where there are multiple pathways from some of the openings to the transducer. The lengths of each shortest pathway from the openings 1620*a*, 1620*b*, 1620*c*, etc., (respectively 1720*a*, 1720*b*, 1720*c*, etc. in FIG. 17) to the transducer 1610 (respectively 1710) are designed to be equal. These embodiments thus favor the direction perpendicular to the plane of the arrangement. The increase in the number of openings and pathways can improve the suppression performance of the apparatus for non-target directions, but the presence of cyclic pathways can also introduce some cancellations for the signal to the target location.

FIG. 18 shows another embodiment which adds more openings to the embodiment of FIG. 17.

FIG. 19 shows another embodiment derived from that of FIG. 18 in which the openings are similarly arranged, but the pathways have been pruned to obtain a tree-like structure that is devoid of looped pathways.

It is understood, that other similar arrangements of openings and pathways are also possible.

Figure 20:
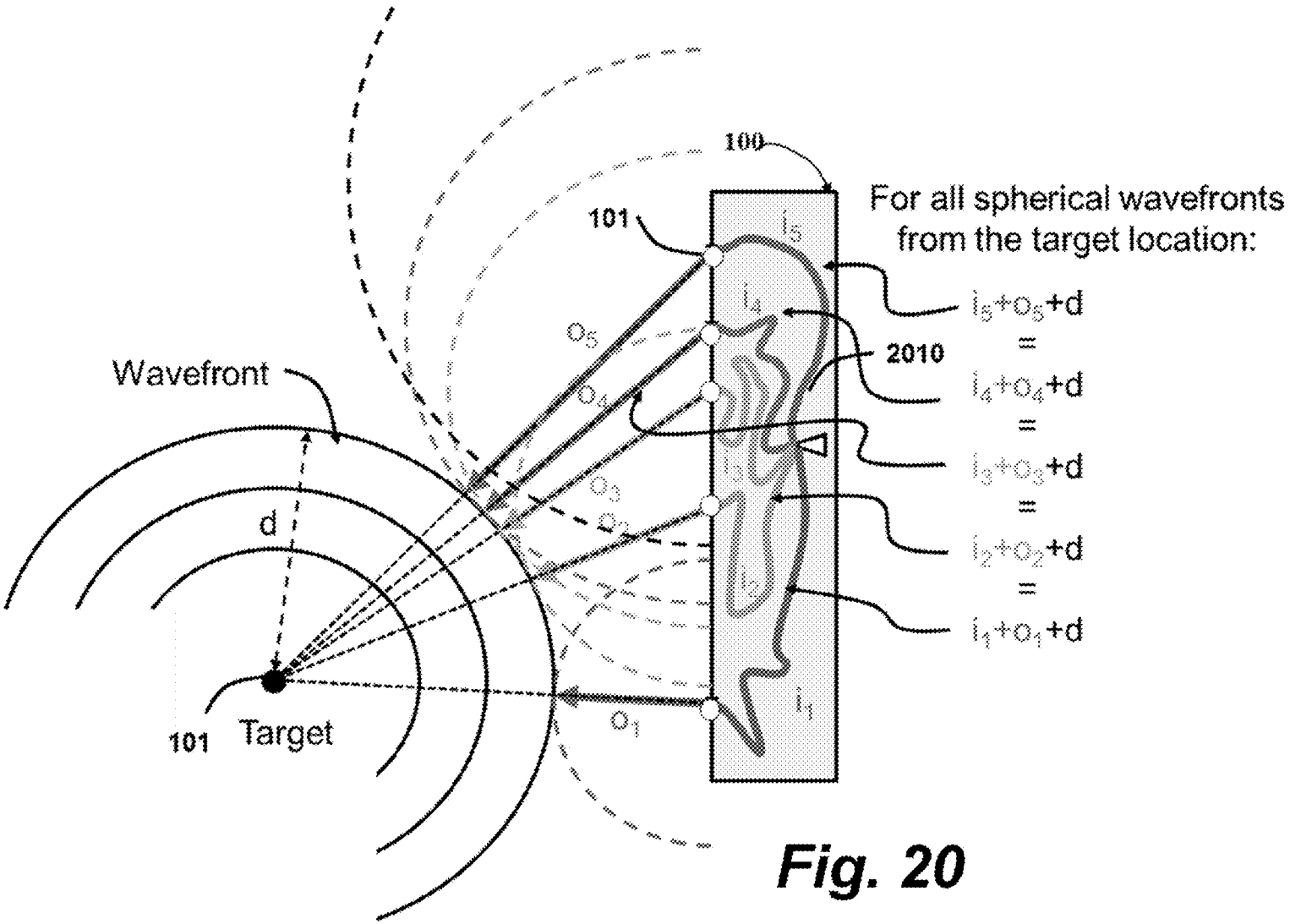
FIG. 20 is a schematic of equal length pathways from an acoustic target location through the openings to the transducer.

FIG. 20 shows an embodiment of the invention which favors a given location. The openings need not be distributed according to a regular pattern. The pathways inside the substrate only need to be designed such that, for each opening, the sum of the length of the pathway inside the substrate plus the length of the straight propagation pathway from the opening to the target location is a constant. For a source at the target location, the propagation of the acoustic waves happens spherically, leading to spherical wavefronts. The signal from the source at any given point of a particular wavefront is in phase. By designing the pathways inside the substrate as described above, the signals that arrive at the transducer through each opening from the source are also in phase. For any wavefront at distance d of the source, the length $i_j$ of the pathway inside the substrate from opening j to the transducer should be set such that $i_j+o_j+d$ is a constant independent of j, where $o_j$ is the length of the pathway from the wavefront to opening j. This is only true for signals from a source at the target location.

Figure 21:
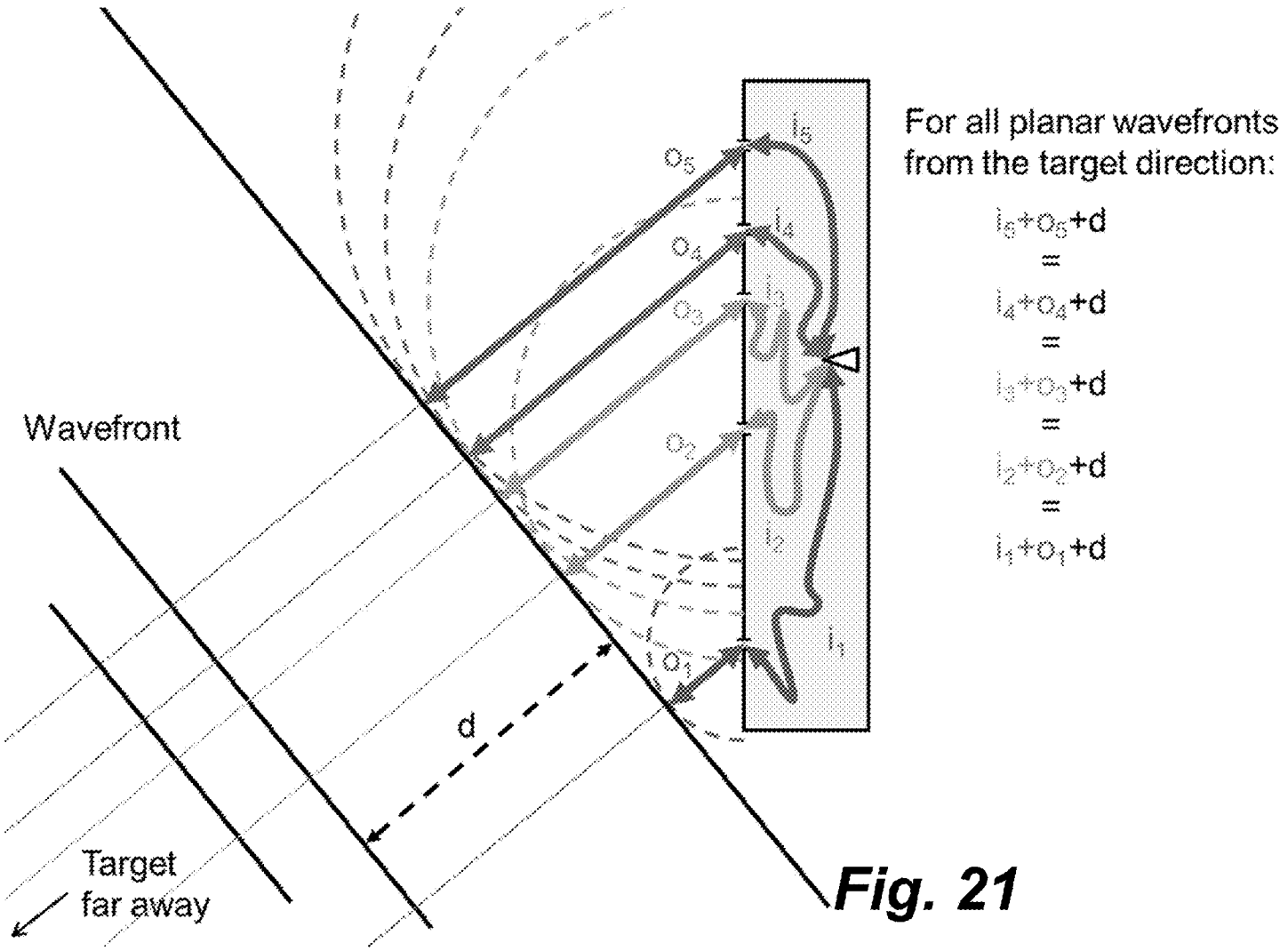
FIG. 21 is a schematic of equal length pathways from a direction of an acoustic target location through openings to the transducer.

FIG. 21 shows an embodiment of the invention which favors a given direction. This case is similar to that of a target location as in FIG. 20, where the target location is considered to be very far away from the apparatus. The wavefronts from a source in the direction of the target location can then be considered to be planar, normal to the target direction. The length $i_j$ of the pathway inside the substrate from opening j to the transducer can be designed such, that for a given wavefront from the target direction, $i_j+o_j$ is a constant independent of j, where $o_j$ is the length of the pathway from the wavefront to opening j. Because the wavefronts are planar and parallel to each other, the independence of $i_j+o_j$ with respect to j is true for all wavefronts from a source in the target direction.

Figure 22:
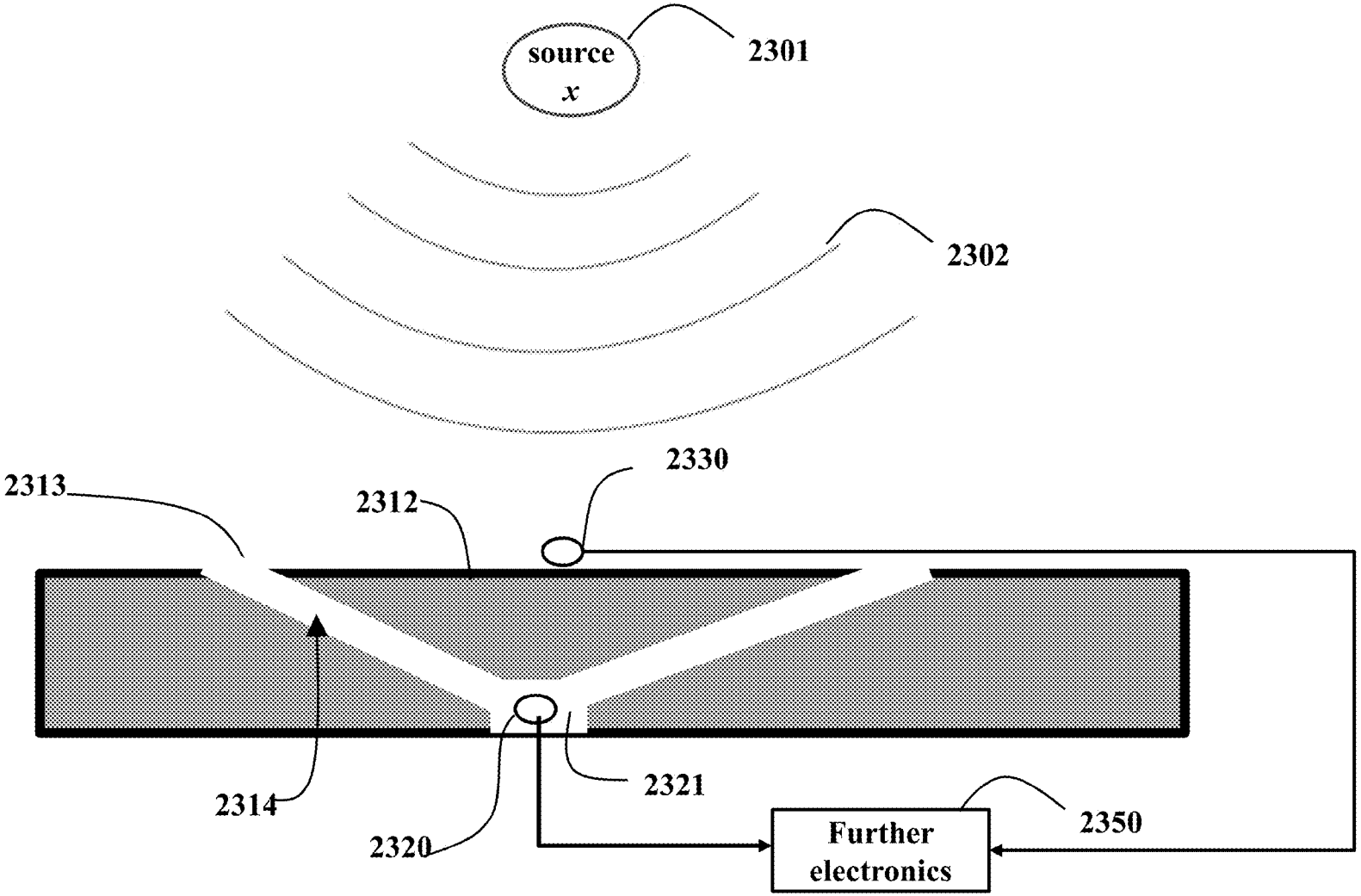
FIG. 22 is a schematic for pathways with different lengths from a direction other than the acoustic target direction through the openings to the transducer.

As shown in FIG. 22, this is not true for a wavefront from a source in a direction other than the target direction.

Figure 23:
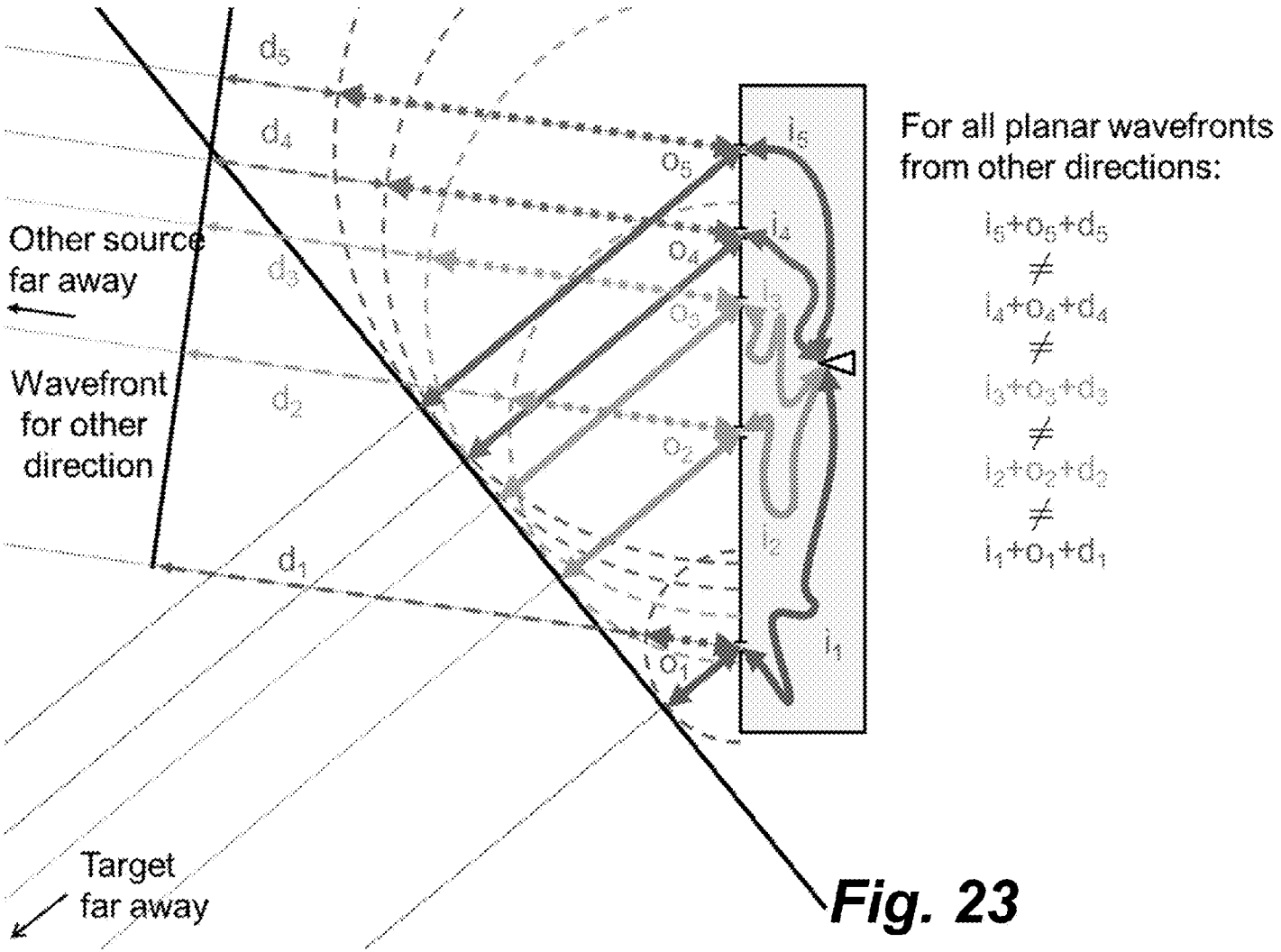
FIG. 23 is a schematic with one or more auxiliary transducers arranged externally to the substrate.

FIG. 23 shows an embodiment of the invention similar to that of FIG. 1, with one or more auxiliary transducers 2330 arranged externally to the substrate. Although the transducer 2320 inside the cavity 2321 is very directional, its acoustic characteristics may not be ideal. In that case, we can use that signal from the transducer 2320 as side information to process the signal from the outside transducer 2330, for example using speech activity detection application, or some sort of filtering.

Because of the necessarily convoluted pathways to produce the appropriate time delays, the substrate 112 can be formed as a three-dimension (3D) printed object, rather than being molded or milled by conventional tooling and manufacturing techniques. Use of 3D printing allows acoustic pathways to pass above or below each other, relaxing the somewhat convoluted pathways as shown in FIGS. 10 and 11.

It is not a requirement that the openings are arranged in a plane. A curved surface containing the openings can serve equally well provided the principle of equal pathway length from openings to transducer is consistently observed. In fact, the substrate can have any arbitrary shape to conform to the environment in which it is used.

Acoustic Speaker

Furthermore, the system is reversible. The transducer as described above is used as a microphone. However, the transducer can be a speaker instead of the microphone, producing a highly directional loudspeaker.

Other Advantages and Extensions

It is not a requirement that only a single set of openings, pathways, and acoustic transducer is used. In some embodiments, the substrate includes two or more transducers, wherein there is a set of openings and a set of pathways exclusive for each transducer. The embodiments allow two different spatial selectivity patterns to be simultaneously used, for example, in a stereo microphone. In other embodiments the openings and pathways can be shared.

Figure 12:
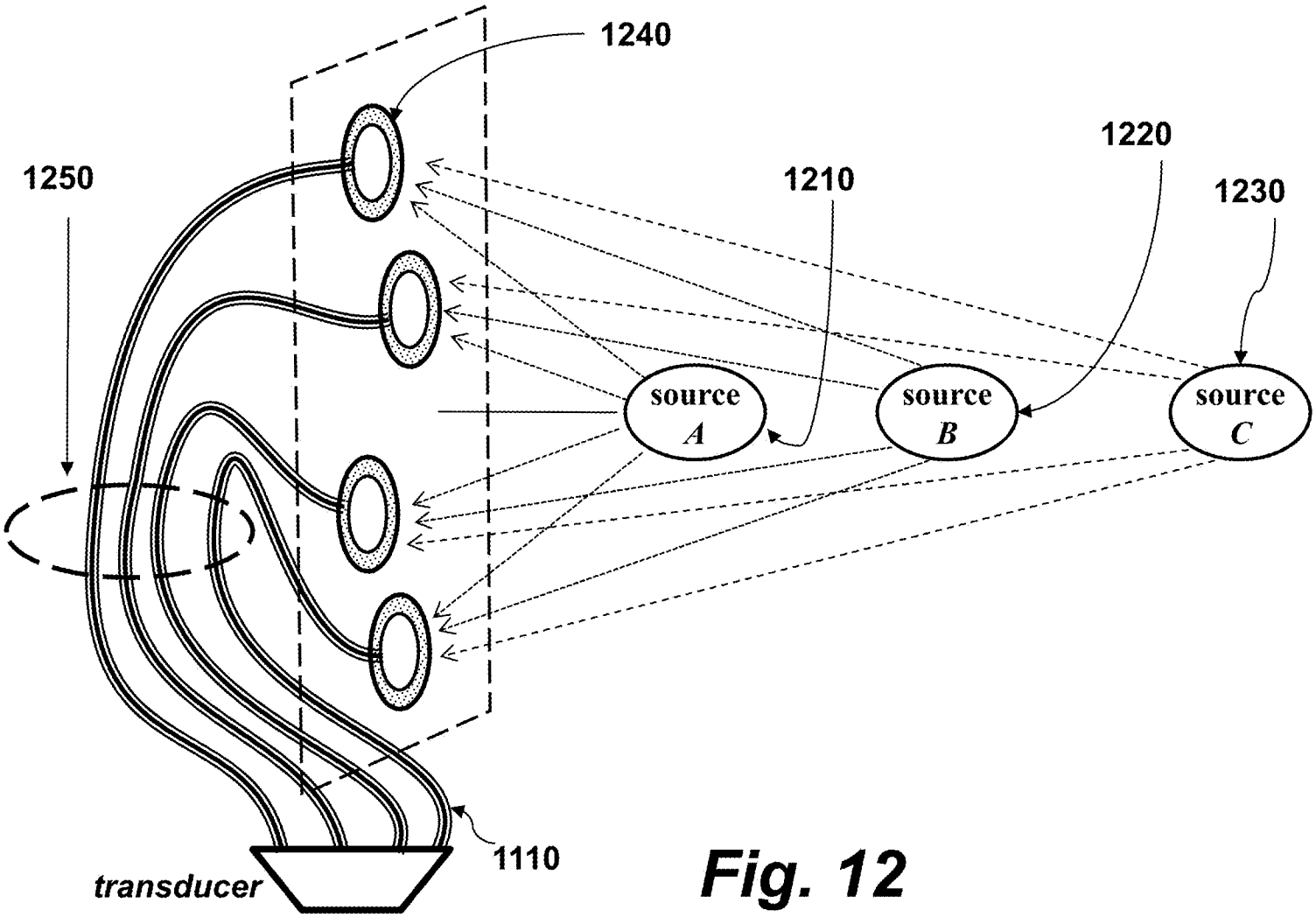
FIG. 12 is schematic of a pattern of openings arranged to provide an acoustic depth of field according to one embodiment of the invention.

Referring now to FIG. 12, there are three acoustic sources A 1210, B 1220, and C 1230, an array of, e.g., four openings 1240, and a corresponding set of acoustic pathways 1250 and transducer 1110. The acoustic pathways are specifically designed so that the total pathway length from source B 1220 to any of the openings 1240 and through the corresponding acoustic pathway 1250 to the transducer 1110 are equal, so that acoustic energy arrives at the transducer 1110 in-phase to achieve constructive interference.

However, acoustic energy from sources A 1210 or C 1230 propagates along pathways with unequal lengths, which depend on the openings 1240 and corresponding pathways 1250 along which the energy propagates. Thus, the time delay varies for each pathway so that the signals from sources A or C at the transducer are not in phase, and there is destructive interference.

Therefore, it is an advantage of the invention that, unlike a shotgun or parabolic microphone, the invention also has acoustic depth of field. That is, the equal and unequal lengths can distinguish acoustic signals from or to locations at different distances from the substrate. This is the analog of optical "depth of field." That is, the principle of equal acoustic pathway lengths includes the slant range from the opening to the acoustic source, so that not only do acoustics originating farther away from the target region register more weakly, but also that acoustics originating closer than the target region register more weakly. This is not achievable in the prior art of parabolic or shotgun microphones.

Figure 13:
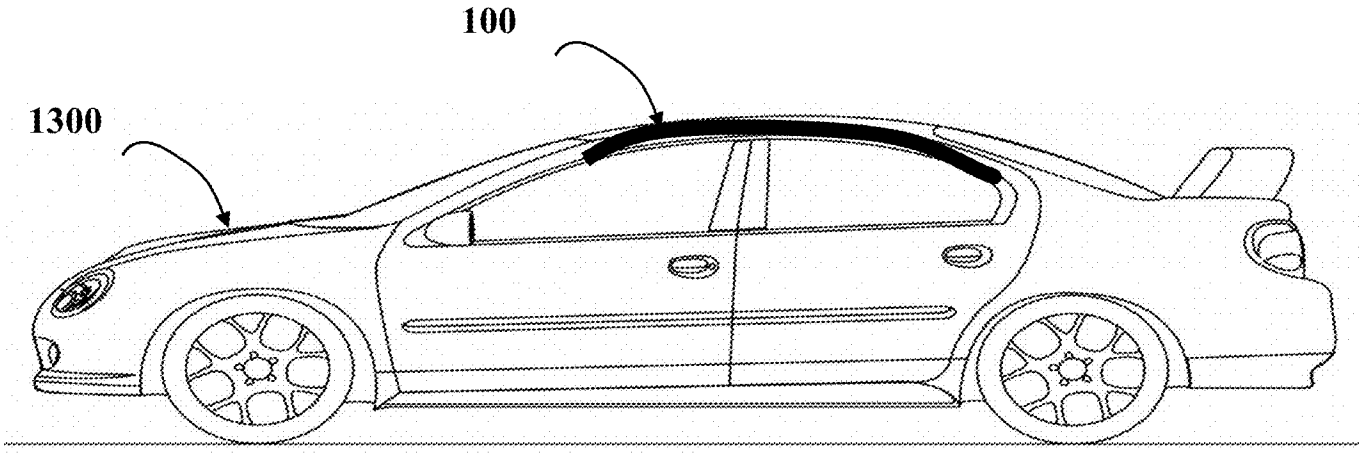
FIG. 13 is a schematic of an acoustic apparatus arranged in a vehicle according to embodiments of the invention.

As shown in FIG. 13, since the embodiments are all mutually compatible, it is relatively simple to combine various embodiments, for example, in an interior ceiling liner, dashboard, or anywhere else in a vehicle 1300. For example, the liner can be curved to conform to the interior roof of the vehicle. Hence, the substrate can be constructed to also conform to the liner with sets of openings, pathways, and transducers (providing separate sensitivity patterns for the driver, and passenger areas. In addition, the substrate can include transducers that provide both microphone and loudspeaker service to those areas, with the microphone sensitivity pattern intentionally placed slightly below the loudspeaker pattern by use of the acoustic depth of field phenomenon, and thus, providing better talk/listen isolation, and "hands free" operation for telephonic applications.

As a variation on this, it is possible to share some or all of the openings and parts of the acoustic pathways between multiple transducers and external target directions, economizing on the thickness of the apparatus.

Acoustic Pathways Details

The length of each pathway is designed in such a way that acoustic signals from or to a given location or direction are selectively emphasized compared to other locations or directions. We assume here for simplicity of explanation that there are J points of entry, e.g., openings 113, but one can also consider a continuum of points of entry. We denote by $i_j$ a length that the signal has to go through from the $j^{th}$ point of entry into the surface to the transducer.

For the source at point x 101 in free space, we denote by $o_j(x)$ the distance between x and the j-th point of entry. The signal that reaches the transducer from a source s(t) located at x is $$\tilde{s}(t) = \Sigma_j \frac{\varepsilon}{o_j(x)} s(t - \tau_j(x)), \quad (1)$$

where $\epsilon$ is a minimum reference distance around the source, and $\tau_j(x)$ is a delay from the source to the microphone obtained as $$\tau_j(x) = (o_j(x) + i_j)/c, \quad (2)$$

where c is the speed of the acoustic signal. We assume that there is no attenuation of energy after the signal enters an opening.

Sources located at x, such that the quantity $o_j(x)+i_j$ is equal for all j, are reinforced by the sum in equation (1), because all delays are equal. That is not the case, or to a lesser extent, for other locations. The length $i_j$ inside the substrate can be determined to favor a particular location. In the case, when that particular location is far away, compared to the size of the device, the device favors the direction of that particular location over other directions.

We now describe example configurations in detail.

For example, FIGS. 4-9 show configurations of the openings and transducer and their corresponding energy attenuation patterns. The device has n holes equally placed on a circle, with radius r=20 cm. The transducer 120 is located $\epsilon$=1 cm behind the center of the circle and y cm to the right in the horizontal plane with respect to the front surface. For simplicity, we assume straight pathways from each hole to the transducer. For the energy attenuation patterns, we consider a sinusoidal source signal with frequency f Hz.

FIG. 4 shows the above configuration with y=0, for which all inside distances are equal, with n=8 holes.

FIG. 5 shows the corresponding energy attenuation pattern (dB) in the horizontal plane (z=0), for n=8 holes, y=0 (inside distances all equal), and f=1000 Hz. In this case, the central direction is then preferred.

FIG. 6 shows the above configuration with y=0, for which all inside distances are equal, with n=32 holes.

FIG. 7 shows the corresponding energy attenuation pattern (dB) in the horizontal plane (z=0), for n=32 holes, y=0 (inside distances all equal) and f=1000 Hz. Again, the transducer prefers the central direction.

FIG. 8 shows a configuration where y=10 cm. The inside distances are no longer equal for all openings.

FIG. 9 shows the corresponding energy attenuation pattern (dB) in the horizontal plane (z=0), for n=8 holes, y=10 cm and f=1000 Hz. In this configuration, the transducer strongly prefers a direction that deviates from the central direction in the opposite of the displacement direction of the transducer.

In the configurations showed above, the acoustic pathways join only at the transducer. The acoustic pathways can also form a branched tree, where a single pathway can split into several pathways, either dividing or combining acoustic energy according to the direction of operation. Examples of such configurations are showed in FIGS. 14-15.

FIGS. 16, 17 and 18 show configurations in which there can be multiple acoustic pathways between a given opening and the transducer. These configurations may however suffer from the presence of loops in the pathways inside the substrate: these loops may cause cancellations in the signal from the source in the target direction or at the target location.

FIG. 19 shows a configuration derived from FIG. 18 where the pathways are pruned so as to remove cycles.

FIG. 22 shows a configuration in which there is another transducer arranged externally to the substrate. This outside transducer can be used as the main transducer, and the signals from the inside transducer can be used as side information, e.g., for speech activity detection or to perform some form of filtering.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A directional acoustic apparatus for accommodating an acoustic signal to or from one or more selected target locations in an acoustic environment of the apparatus, comprising:

a substrate having a structural configuration including:

a thickness about two orders of magnitude smaller than a width and a length of the substrate;

a single acoustic transducer arranged in communication with the substrate; and a plurality of substrate acoustic pathways formed inside the substrate, wherein each substrate acoustic pathway has a predetermined length, from a proximal end of each substrate acoustic pathway forming an opening in a surface of the substrate, to a distal end terminating at the single acoustic transducer, wherein the predetermined substrate acoustic pathway lengths induce substrate acoustic pathway time delays for the acoustic signal traveling from the distal end to the proximal end, and a location of each substrate opening induces an environment time delay for the acoustic signal traveling between a selected target location and the substrate opening, wherein the substrate acoustic pathway lengths and the substrate opening locations are designed such that, for each selected target location, the sum of the substrate acoustic pathway time delay and the environment time delay is approximately equal for all substrate acoustic pathways, such as to form an acoustic spatial filter that selectively passes acoustic signals from or to different locations in the acoustic environment.

2. The apparatus of claim 1, wherein the predetermined lengths are equal, and the substrate openings are arranged in a circular pattern, with the transducer at a center of the pattern.

3. The apparatus of claim 1, wherein the substrate acoustic pathways form a branched tree, where a single substrate acoustic pathway can split into several substrate acoustic pathways, either dividing or combining acoustic energy according to a desired direction of operation.

4. The apparatus of claim 1, wherein the predetermined lengths of the substrate acoustic pathways have a preferred directed response perpendicular to a front surface of the substrate.

5. The apparatus of claim 1, wherein the substrate acoustic pathways are of equal predetermined lengths and have multiple branches from the substrate openings to the transducer to favor a direction perpendicular to a front surface of the substrate.

6. The apparatus of claim 1, wherein the transducer converts electric energy to acoustic energy, and the apparatus operates as a speaker.

7. The apparatus of claim 1, wherein the transducer converts acoustic energy to electric energy, and apparatus operates as a microphone.

8. The apparatus of claim 7, wherein there are one of more external microphones.

9. The apparatus of claim 8, wherein the acoustic signals associated with the transducer in a cavity of the substrate are used as side information to process the acoustic signals associated with the external microphones.

10. The apparatus of claim 9, wherein the side information is used in a speech activity detection application.

11. The apparatus of claim 1, wherein the substrate acoustic pathways are of equal predetermined lengths and have multiple branches to obtain a tree-like structure.

12. The apparatus of claim 1, wherein the substrate has an arbitrary shape.

13. The apparatus of claim 1, wherein the substrate acoustic pathways are shared among the openings.

14. The apparatus of claim 1, wherein the substrate includes two or more transducers, wherein there is a set of openings and a set of substrate acoustic pathways exclusively for each transducer.

15. The apparatus of claim 14, wherein the predetermined lengths of some of the substrate acoustic pathways are equal to achieve constructive interference, and the predetermined lengths of other substrate acoustic pathways are unequal to achieve destructive interference.

16. The apparatus of claim 15, wherein the substrate acoustic pathways with the equal predetermined lengths and the substrate acoustic pathways with the unequal predetermined lengths distinguish the acoustic signals from or to locations at different distances from the substrate.

17. The apparatus of claim 1, wherein the substrate is arranged in a vehicle.

18. The apparatus of claim 17, wherein the apparatus provides separate sensitivity patterns for a driver and passenger areas.

19. A directional acoustic apparatus for accommodating an acoustic signal to or from one or more selected target locations in an acoustic environment of the apparatus, comprising:

a substrate having a structural configuration including:

a thickness about two orders of magnitude smaller than a width and a length of the substrate;

a single acoustic transducer arranged in communication with the substrate; and a plurality of substrate acoustic pathways formed inside the substrate, wherein each substrate acoustic pathway has a predetermined substrate length, from a proximal end of each substrate acoustic pathway forming a substrate opening in a surface of the substrate, to a distal end terminating at the single acoustic transducer, wherein the predetermined substrate acoustic pathway lengths induce substrate acoustic pathway time delays for the acoustic signal traveling from the distal end to the proximal end, and a location of each substrate opening induces an environment time delay for the acoustic signal traveling between a selected target location and the substrate opening, wherein the substrate acoustic pathway lengths and the substrate opening locations are designed such that, for each selected target location, the sum of the substrate acoustic pathway time delay and the environment time delay is approximately equal for all substrate acoustic pathways, and for one or more locations different from the one or more selected target locations, a sum of the substrate acoustic pathway time delay and an environment time delay is not equal for all substrate acoustic pathways, such as to form an acoustic spatial filter that selectively passes acoustic signals from or to different locations in the acoustic environment that are passive acoustic processed signals.

* * * * *